US011015767B1

(12) United States Patent
Liang

(10) Patent No.: US 11,015,767 B1
(45) Date of Patent: May 25, 2021

(54) EASY-TO-ASSEMBLE INTEGRATED LED BULB LAMP

(71) Applicant: Nanning City Hong Cai Illuminations Technology Company Limited, Nanning (CN)

(72) Inventor: Faquan Liang, Nanning (CN)

(73) Assignee: Nanning City Hong Cai Illuminations Technology Company Limited, Nanning (CN)

( * ) Notice: Subject to any disclaimer, the term of this patent is extended or adjusted under 35 U.S.C. 154(b) by 0 days.

(21) Appl. No.: 17/247,671

(22) Filed: Dec. 18, 2020

(30) Foreign Application Priority Data

Dec. 9, 2020 (CN) ..... 202011427171.4

(51) Int. Cl.

| | |
|---|---|
| ***F21V 23/00*** | (2015.01) |
| ***H01J 5/54*** | (2006.01) |
| ***F21K 9/232*** | (2016.01) |
| ***F21K 9/238*** | (2016.01) |
| ***F21V 3/02*** | (2006.01) |
| ***F21K 9/237*** | (2016.01) |
| *F21Y 115/10* | (2016.01) |

(52) U.S. Cl.
CPC ..... *F21K 9/232* (2016.08); *F21K 9/237* (2016.08); *F21K 9/238* (2016.08); *F21V 3/02* (2013.01); *F21Y 2115/10* (2016.08)

(58) Field of Classification Search
CPC ..... F21K 9/232; F21K 9/235; F21K 9/238; F21V 3/02; F21V 23/00; H01J 5/54
See application file for complete search history.

(56) References Cited

U.S. PATENT DOCUMENTS

| | | | | |
|---|---|---|---|---|
| 2012/0161626 | A1* | 6/2012 | van de Ven | F21V 29/83 315/35 |
| 2016/0088693 | A1* | 3/2016 | Zhao | F21V 23/006 315/51 |
| 2018/0106436 | A1* | 4/2018 | Wittmann | H01L 51/0097 |
| 2019/0203921 | A1* | 7/2019 | He | F21V 7/22 |

* cited by examiner

*Primary Examiner* — Karabi Guharay
(74) *Attorney, Agent, or Firm* — Wang Law Firm, Inc.

(57) ABSTRACT

An easy-to-assemble integrated LED bulb lamp includes a lampshade, a bulb base, a lamp cap, an LED module, a driver IC, a resistor, a lampshade and a lamp cap that form a sealed cavity. The bulb base is installed to an opening of the lampshade to divide the sealed cavity into an upper compartment and a lower compartment; the LED module is installed in the upper compartment; and the LED module is partially inserted into the bulb base and connected to the driver IC in the bulb base. Since the driver IC and the LED module can be integrally fixed during the injection molding of the bulb base, therefore the actual assembling process only requires the step of soldering the solder point of the resistor, and the assembling process can be simplified significantly to increase productivity.

6 Claims, 4 Drawing Sheets

EASY-TO-ASSEMBLE INTEGRATED LED BULB LAMP

FIELD OF INVENTION

The present invention relates to the technical field of LED lighting, in particular to an easy-to-assemble integrated LED bulb lamp capable of lowering the level of difficulty and simplifying the manufacture of LED bulb lamps significantly.

BACKGROUND OF INVENTION

Description of the Related Art

LED having the feature of unique power consumption for light emission and the advantage of environmental protection are used extensively in different fields. To meet the usage requirement of a traditional bulb base and substitute traditional tungsten bulbs or fluorescent bulbs by LED bulbs, it is necessary to adopt and connect the traditional bulb base having a spiral snap slot to a snap-on bulb base, so that the LED bulb lamp can be mass produced and used.

In general, a conventional LED bulb lamp includes a lampshade, an LED light strip, a bulb base, and a lamp cap, and at least one LED light strip is installed on the bulb base to form a combined body, and the combined body is placed into a bulb cavity which is formed by the lampshade and the lamp cap. Since the operation of the LED light strip is inseparable from a drive circuit, it is necessary to install a plurality of electrical components in the lamp cap which is disposed at the tail of the bulb lamp and coupled to the LED light strip, and the aforementioned assembly of the electrical components forms a drive component.

Specifically, the conventional drive component is independently separated from the bulb base and the LED light strip as shown in FIG. 4, so that the LED light strip is integrated with the bulb base as a whole during an injection molding process for the production, and then each electrical component of the drive component with a pin extending from the bulb base is welded manually and coupled to the LED light strip. In the aforementioned process, the welding is a separate welding without having any substrate, so that automated welding is unfavorable and manufacturers have to rely on manual welding. As a result, the mass production of the LED bulb lamps requires a large number of workers and incurs a high labor cost. Furthermore, the labor shortage decreases the overall production efficiency and increases the production cost of the LED bulb lamps, and thus the manual welding fails to comply with the trend and direction of the development of modern enterprise production In summation, the structure of the conventional LED bulb lamps restricts production efficiency and increases production cost. Obviously the conventional LED bulb lamps require further improvements.

SUMMARY OF THE INVENTION

It is a primary objective of the present invention to overcome the drawbacks of the prior art by providing an easy-to-assemble integrated LED bulb lamp, wherein electrical components are integrated and welded with an LED light strip, and then a bulb base in a specific shape is formed by automation equipment to facilitate and expedite the assembling process.

To achieve the aforementioned and other objectives, the present invention discloses an easy-to-assemble integrated LED bulb lamp, comprising: a lampshade, a bulb base, a lamp cap, an LED module, a driver IC, a resistor, a lampshade, and a lamp cap that form a sealed cavity, characterized in that the bulb base is snapped on and installed into an opening of the lampshade, and the sealed cavity is divided into an upper compartment and a lower compartment; the LED module is installed in the upper compartment; the LED module is partially inserted into the bulb base and coupled to the driver IC in the bulb base; the driver IC is further coupled to a first pin and a second pin that extend out from the bulb base; the resistor is disposed in the lower compartment, and the first pin is electrically coupled to the resistor; the resistor is electrically coupled to a central portion of the bottom of the lamp cap; the second pin is electrically coupled to an inner wall of the lamp cap through an electrical connecting part which is disposed in the lower compartment; the bulb base comprises a column-shaped body, an upper boss disposed on an upper surface of the column-shaped body upper surface, and a lower boss disposed on a lower surface of the column-shaped body; and the lower boss is provided for separating the first pin and the second pin.

Further, the LED module comprises a light stand, a light strip, and at least one light strip installed onto the light stand.

Further, the upper boss is substantially in the shape of an isosceles trapezoid, and the driver IC is embedded into the upper boss.

Further, the lower boss is substantially in the shape of a right-angled trapezoid.

Further, the upper boss and the lower boss are staggered by 90 degrees in the radial direction with the column-shaped body as the center, and staggered substantially in a cross shape.

Further, the electrical connecting part is substantially U-shaped, and a side of the electrical connecting part touches an inner side of the lamp cap, and the touching side is substantially bent in waves.

In the implementation of the present invention, the driver IC and the LED module can be integrally fixed during the injection molding of the bulb base, so that the actual assembling process only requires the step of soldering the solder point of the resistor, and the assembling process can be simplified significantly to increase productivity.

BRIEF DESCRIPTION OF THE DRAWINGS

The present invention will become clearer in light of the following detailed description of an illustrative embodiment of this invention described in connection with the drawings.

DESCRIPTION OF THE PREFERRED EMBODIMENTS

Figure 1:
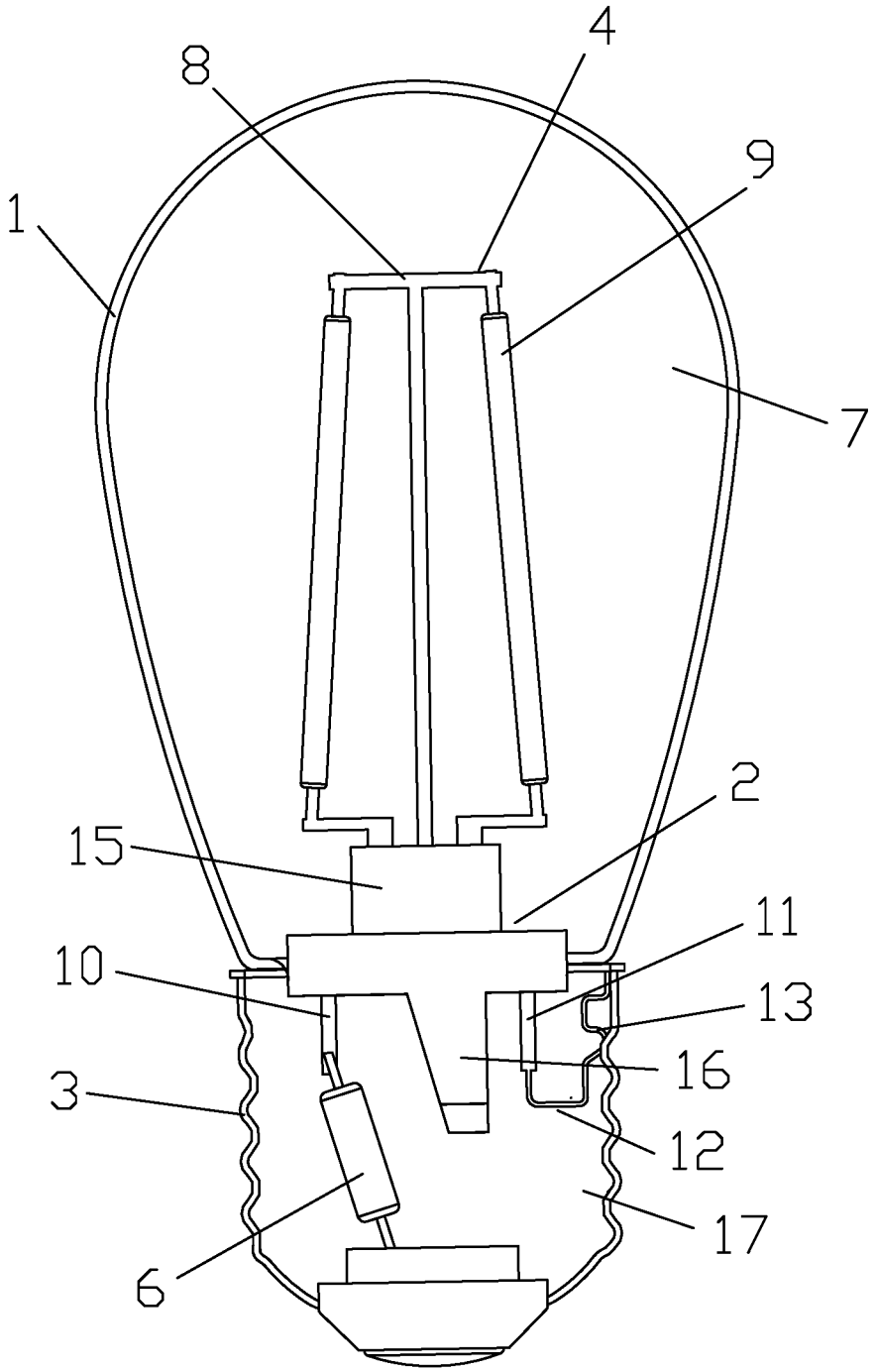
FIG. 1 is a schematic view showing the structure of the present invention.

Exemplary embodiments are illustrated in referenced figures of the drawings. It is intended that the embodiments and figures disclosed herein are to be considered illustrative rather than restrictive.

It is noteworthy that similar numerals and alphabets used in the drawings represent similar items, so that once an item is defined in a drawing, and the item shown in subsequent drawings no longer needs to be discussed further.

In the description of this invention, it should be understood that the terms "upright", "top", "bottom", "level", etc. refer to an indicated orientation and a positional relation based on the orientation and positional relation as shown in the attached drawings. These terms are used for the purpose of describing the creation of this disclosure and simplifying the description, but not intended for indicating or implying that the device or component must have the specific position, the specific positional structure and operation, so that these terms should not be construed as a limitation on this disclosure.

In the description of the present invention, it is noteworthy that the terms "disposed", "installed", "connected", "coupled", etc. should be interpreted broadly, unless otherwise specified and restricted clearly, and persons having ordinary skill in the art should be able to understand the specific meaning of the aforementioned terms used in the present invention according to the specific circumstances.

Figure 2:
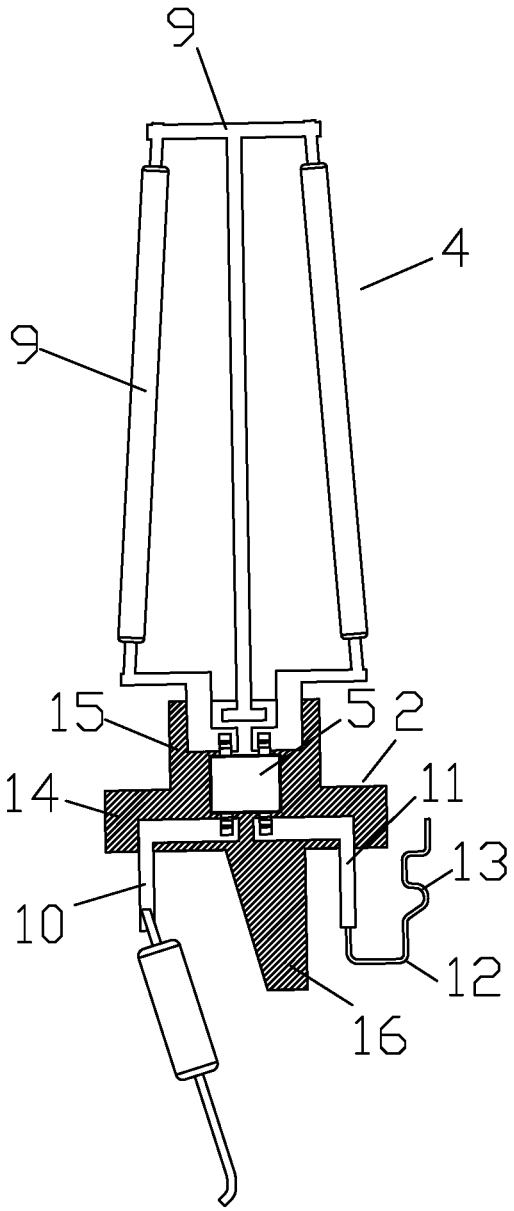
FIG. 2 is a schematic view showing the internal structure of the present invention after an LED module, a bulb base, and a resistor are assembled.
Figure 3:
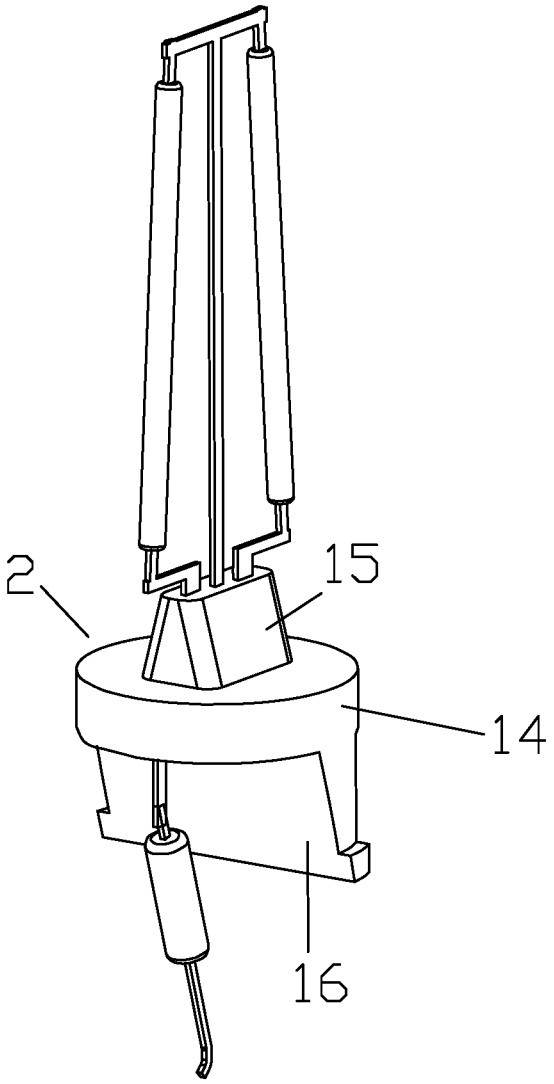
FIG. 3 is a schematic view showing the structure of the present invention after an LED module, a bulb base, and a resistor are assembled.
Figure 4:
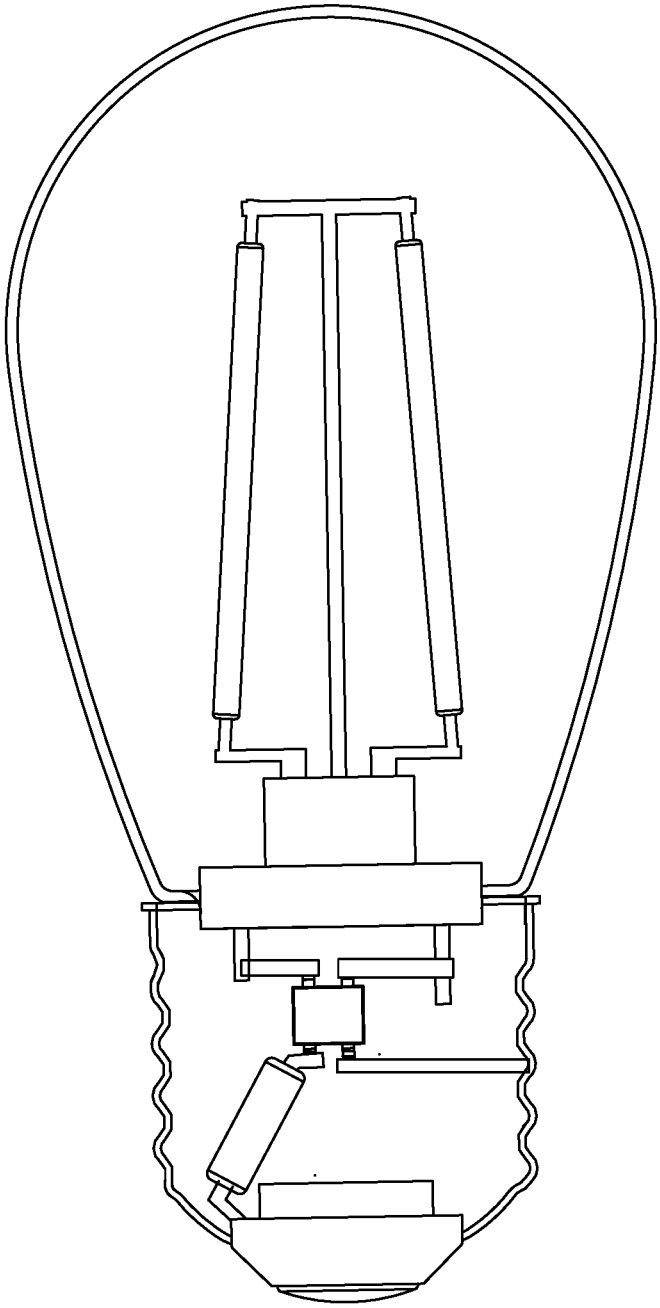
Prior Art FIG.4
FIG. 4 is a schematic view showing the structure of a conventional LED bulb lamp.

With reference to FIGS. 1 to 3 for an easy-to-assembly integrated LED bulb lamp in accordance with an embodiment of the present invention, the LED bulb lamp comprises a lampshade 1, a bulb base 2, a lamp cap 3, an LED module 4, a driver IC 5, a resistor 6, a lampshade 1 and a lamp cap 3 that form a sealed cavity. The bulb base 2 is snapped and installed onto an opening of the lampshade 1 to separate the sealed cavity into an upper compartment 7 and a lower compartment 17; the LED module 4 is installed in the upper compartment 7; the LED module 4 comprises a light stand 8, a light strip 9, and two light strips 9 installed onto the light stand 8; the light stand 8 of LED module 4 is plugged into the bulb base 2 and coupled to the driver IC 5 which is embedded in the bulb base 2; the driver IC 5 is further coupled to a first pin 10 and a second pin 11 which extend out from the bulb base 2; the resistor 6 is disposed in the lower compartment 8, and the first pin 10 is electrically coupled to the resistor 6; and the resistor 6 is electrically coupled to a central portion of the bottom of the lamp cap 3; the second pin 11 is coupled to an U-shaped electrical connecting part 12 which is disposed in the lower compartment 17; a side of the electrical connecting part 12 touches an inner wall of the lamp cap 3, and the touching side 13 is bent into waves; the bulb base 2 comprises a column-shaped body 14, an upper boss 15 disposed on an upper surface of the column-shaped body 14, and a lower boss 16 disposed on a lower surface of the column-shaped body 14; the upper boss 15 and the lower boss 16 are staggered by 90 degrees in the radial direction with the column-shaped body 14 as the center and staggered substantially in a cross shape. The upper boss 15 is substantially in the shape of an isosceles trapezoid, and the driver IC 5 is embedded into the upper boss 15; and the lower boss 16 is substantially in the shape of a right-angled trapezoid; and the first pin 10 and the second pin 11 are separated from each other.

While the invention has been described by means of specific embodiments, numerous modifications and variations could be made thereto by those skilled in the art without departing from the scope and spirit of the invention set forth in the claims.

What is claimed is:

1. An easy-to-assemble integrated LED bulb lamp, comprising:

a lampshade;

a bulb base attached to an opening of the lampshade;

a lamp cap attached to the lampshade;

an LED module placed inside the lampshade;

a driver IC embedded inside the bulb base; and a resistor electrically connected to the lamp cap, wherein the lampshade and the lamp cap form a sealed cavity, and the sealed cavity is divided into an upper compartment and a lower compartment;

the LED module is installed in the upper compartment;

the LED module is partially inserted into the bulb base and coupled to the driver IC in the bulb base;

the driver IC is further coupled to a first pin and a second pin that extend outwardly from the bulb base;

the resistor is disposed in the lower compartment and electrically coupled to the first pin;

the second pin is electrically coupled to an inner wall of the lamp cap through an electrical connecting part which is disposed in the lower compartment;

the bulb base comprises a column-shaped body, an upper boss disposed on an upper surface of the column-shaped body upper surface, and a lower boss disposed on a lower surface of the column-shaped body; and the lower boss having a vertical length longer than length of first pin and the second pin and a width extending from one end of the lamp cap to an opposite end of the lamp cap for isolating the first pin from the second pin.

2. The easy-to-assemble integrated LED bulb lamp as claimed in claim 1, wherein the LED module comprises a light stand, a light strip, and at least one light strip installed onto the light stand.

3. The easy-to-assemble integrated LED bulb lamp as claimed in claim 1, wherein the upper boss is substantially in the shape of an isosceles trapezoid, and the driver IC is embedded into the upper boss.

4. The easy-to-assemble integrated LED bulb lamp as claimed in claim 1, wherein the lower boss is substantially in the shape of a right-angled trapezoid.

5. The easy-to-assemble integrated LED bulb lamp as claimed in claim 1, wherein the upper boss and the lower boss are staggered by 90 degrees in the radial direction with the column-shaped body as the center, and staggered substantially in a cross shape.

6. The easy-to-assemble integrated LED bulb lamp as claimed in claim 1, wherein the electrical connecting part is substantially U-shaped, and a side of the electrical connecting part touches an inner side of the lamp cap, and the touching side is substantially bent in waves.

* * * * *